United States Patent [19]

Kocourek

[11] Patent Number: 4,708,521

[45] Date of Patent: Nov. 24, 1987

[54] BEACH BUILDING BLOCK

[76] Inventor: Peter C. Kocourek, Rte. 1, Box 90A, Whitelaw, Wis. 54247

[21] Appl. No.: 7,602

[22] Filed: Jan. 28, 1987

[51] Int. Cl.[4] ..... E02B 3/04; E02B 3/06

[52] U.S. Cl. ..... 405/31; 405/15; 405/30; 405/33

[58] Field of Search ..... 405/15, 16, 17, 18, 405/19, 20, 21, 23, 24, 25, 29, 30, 31, 32, 33, 34, 35

[56] References Cited

U.S. PATENT DOCUMENTS

| | | | |
|---|---|---|---|
| 2,466,343 | 4/1949 | Weber | 405/33 |
| 3,347,048 | 10/1967 | Brown et al. | 405/33 X |
| 3,386,250 | 6/1968 | Katayama | 405/33 |
| 3,733,831 | 5/1973 | Sticker, Jr. | 405/30 |
| 4,129,006 | 12/1978 | Payne | 405/31 |
| 4,367,978 | 1/1983 | Schaaf et al. | 405/30 |
| 4,407,608 | 10/1983 | Hubbard | 405/31 |
| 4,431,337 | 2/1984 | Iwasa | 405/30 |
| 4,498,805 | 2/1985 | Weir | 405/33 |
| 4,502,816 | 3/1985 | Creter | 405/30 |

FOREIGN PATENT DOCUMENTS

| | | | |
|---|---|---|---|
| 966470 | 10/1950 | France | 405/30 |
| 478094 | 12/1975 | U.S.S.R. | 405/30 |

*Primary Examiner*—Nancy J. Stodola
*Attorney, Agent, or Firm*—Arthur J. Hansmann

[57] ABSTRACT

A beach building block which is formed with a single passageway extending in a vertical inclination therethrough and which presents a solid wall at the rearward side of the block for containment of sand and the like behind the block and thereby build a beach. The blocks are positioned in row parallel to the shoreline, and while they permit the wave to flow through the block, they dissipate the energy of the wave, and they also retard the return flow of the water with the suspended sand, and thus the beach is built behind the block by the deposit of the sand.

9 Claims, 4 Drawing Figures

BEACH BUILDING BLOCK

This invention relates to a beach building block, and, more particularly, it relates to a block which is placed into the body of sea or lake water a distance from the shoreline for creating the build-up of beach material, such as sand and small stone, and the like, between a row of the blocks and the shoreline

BACKGROUND OF THE INVENTION

It is commonly known that water wave action creates a washout of sand and stone at a beach, and there is an erosion problem where the beachline can actually be receding toward the land. The prior art has various configurations of block which is intended to dissipate the wave energy and to reduce the beach material from washing further into the body of water. Blocks of the prior art generally have two functions, one is to dissipate the energy or force of the wave by permitting water to flow through the block, and another is to endeavor to stop the wave flow entirely by blocking the wave with a substantially solid block With regard to permitting the wave to flow through the block, U.S. Pat. Nos. 3,386,250 and 4,129,006 and 4,367,978 and 4,431,337 all show blocks with openings therethrough. However, in that form of block, the water can also reverse flow and move in the seaward direction after it has initially passed the block in the landward direction. In that in-and-out type of flow, the water may be reduced in its wave energy, but the sand and the like which forms a beach is not controlled and it too will be flowing generally outwardly to erode the beach.

In the present invention, the block is designed to actually build a beach, rather than simply endeavor to retard the flow of the wave, and, in the present invention, the sand is deposited behind a row of the blocks to enhance the size of the beach. To accomplish this, the present invention differs from the prior art in that it dissipates the energy of the wave moving landward, but it also serves to have the sand fall out from the wave and thus build the beach. The aforementioned patents are arranged to have the water, and therefore the sand, flow readily and easily in both directions, so that the beach is not actually built or increased in sand, but, it is instead the purpose of the block to simply reduce the energy of the incoming wave. The present invention also accomplishes the desirable effect of reducing the incoming wave energy, but, as mentioned, there is the additional feature of building the size of the beach itself.

Still further, the blocks of the present invention differ from the prior art in that they are susceptible to being positioned in a line in side-by-side relationship and interlocked block-to-block so that the line of blocks is stable and the movement of the water therethrough or thereover will not move the blocks out of line. In conjunction with that stability of the line of blocks, the block of the present invention has the feature of permitting the wave to flow therethrough in a manner which will actually enhance the stability of the position of the block, and the block also has a front toe feature for stability and it has side walls for presenting resistance to a wave directed angularly at the block. All of these several features therefore combine to provide a block which is stable and which can be positioned in a side-by-side relationship to form a line of blocks which will retain their aligned position and thus retard the force of the incoming flow of water and will actually build the beach through the deposit of sand washing toward the shoreline from the body of water.

DETAILED DESCRIPTION OF THE PREFERRED EMBODIMENT

Figure 1:
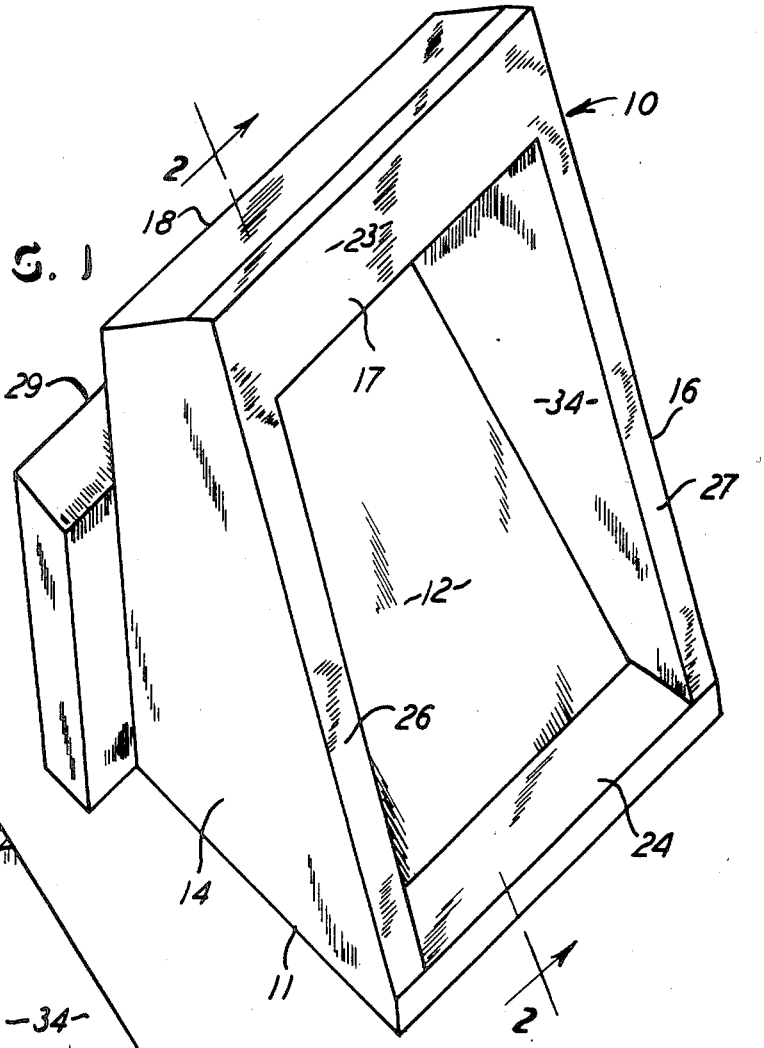
FIG. 1 is a front perspective view of a preferred embodiment of a block of this invention.
Figure 2:
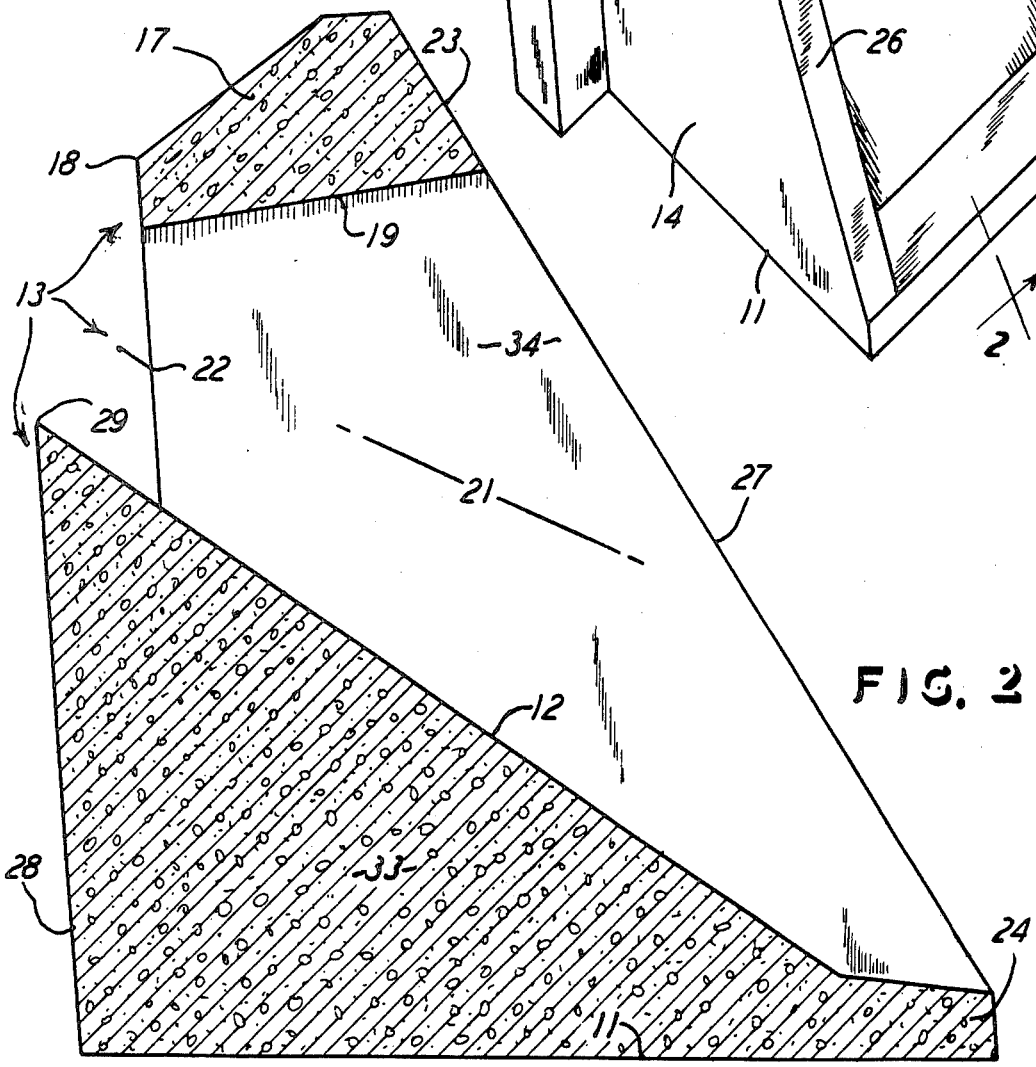
FIG. 2 is an enlarged sectional view taken along the line designated 2—2 in FIG. 1.
Figure 3:
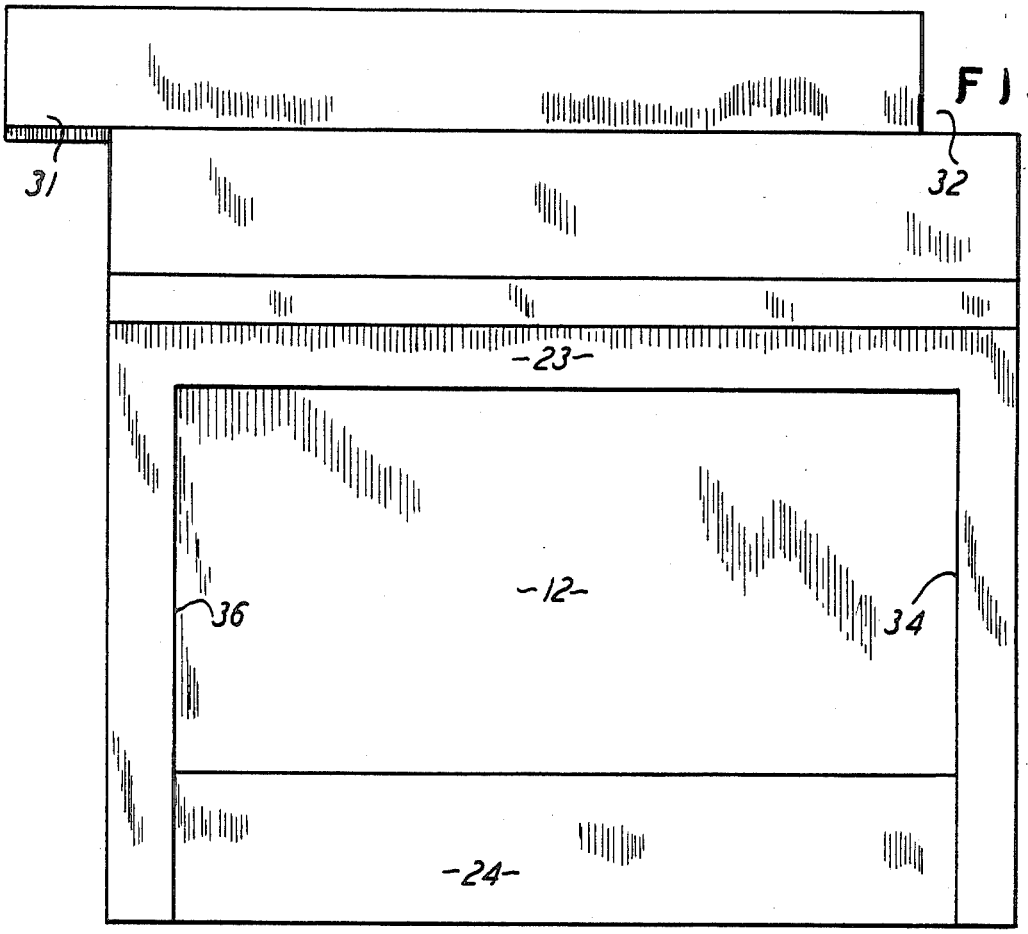
FIG. 3 is an enlarged top view of the block of FIG. 1.

The drawings show the block is generally of a triangular shape, in side view, such as shown in FIGS. 1 and 2, and it is preferably made of poured concrete, and thus the necessary draft angles are included where it is desired to remove it from a pouring form. The block consists of a body designated 10 and it has a planar bottom surface 11 and a seaward-facing inclined surface 12. The body 10 also has a rear or landward-facing surface generally designated 13, and that surface extends upwardly from the bottom surface 11 at an obtuse angle, as most clearly shown in FIG. 2, and to the highest elevation, at the top.

It will therefore be understood that the blocks 10 can be placed in side-by-side position in line and with the inclined surface 12 facing seaward and with the rearward surface 13 facing rearwardly and being generally an upright wall surface. In the arrangement hereinafter described, the blocks 10 are sturdy and stable in the in-line position so that they continue to present a line of blocks disposed parallel to a shoreline and submerged in the water to almost the height of the entire block and preferably to about two-thirds of the height.

FIG. 1 shows the block body 10 also includes two spaced-apart side walls 14 and 16 which flank the inclined surface 12 which is at approximately thirty degrees relative to the bottom surface 11. The side walls 14 and 16 extend upwardly to a top or divider portion 17 which extends across the width of the block and which intersects at 18 with the upright plane of the rear wall 13. FIG. 2 further shows that the top divider portion 17 has a lower surface 19 which faces downwardly to the inclined surface 12, and, with the surface 12, there is a wave passageway, generally defined by the longitudinal line 21, extending from front to rear through the block body 10. It will be further seen and understood that the wave passageway which can be designated 21 converges or becomes narrower toward the rear. With that arrangement, a wave impinging upon the inclined surface 12 will be directed upwardly along the passageway line 21 and part of the wave will be directed against the surface 19 and guided to the rear opening 22. Thus, part of the wave is directed through the opening 22, and another part of the wave is directed over the top portion surface 23 and over the top divider 17. Those two wave portions will collide or intersect at a point behind the block 22 and generally above the level of the block 22, and thus the wave energy is dissipated through its own activity.

FIG. 1 also shows that the body 10 has a forwardly disposed flat toe portion 24 extending between the side walls 14 and 16, and that portions precludes the water from washing excessive sand from underneath the front of the block 10, and thus the block's stability is enhanced. It will also be seen that the side walls 14 and 16 have front surfaces 26 and 27, respectively, which are inclined upwardly but at a steeper angle than the incline of the inclined surface 12 against which the water is generally flowing.

Figure 4:
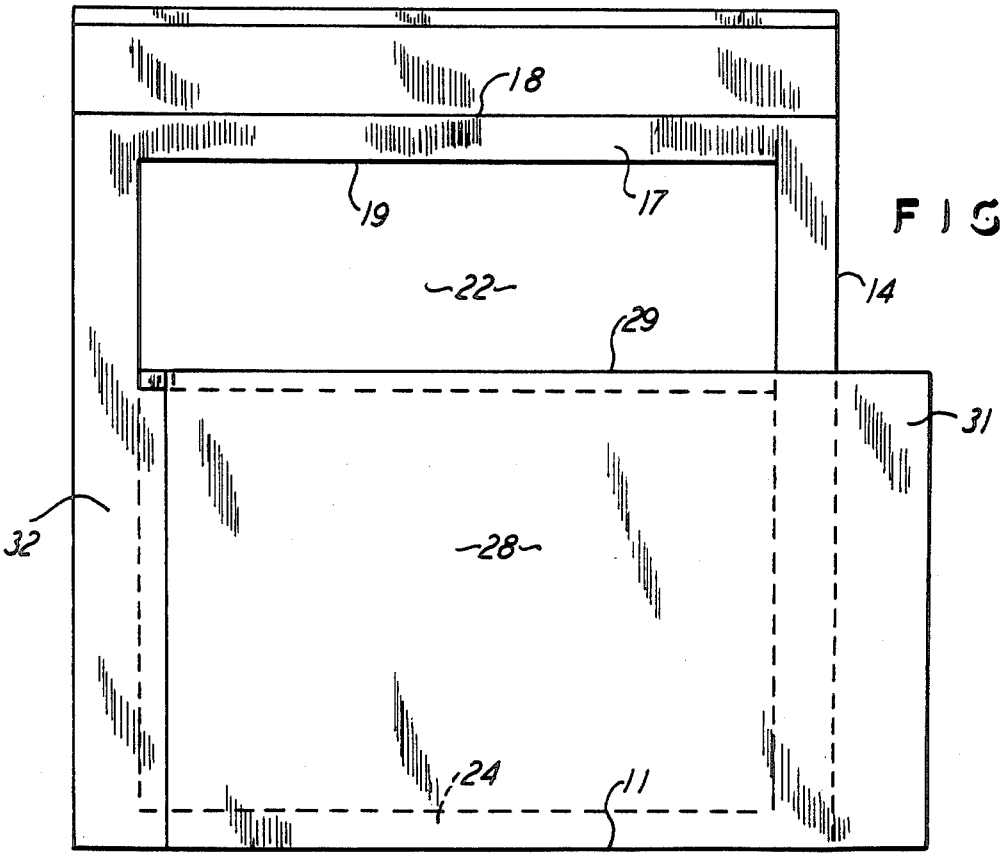
FIG. 4 is an enlarged rear view of the block of FIG. 1.

FIGS. 2 and 4 show that the rear surface or wall 13 is a solid wall for the majority of the rear wall portion and as designated 28. The solid wall portion 28 extends for substantially the entire width of the block 10 and it extends substantially over at least one-half of the height of the block 10 and basically upwardly to at least two-thirds of the vertical height of the front of the passageway 21. With that arrangement, once the water and its sand has passed the block 10, the return flow in the seaward direction will be blocked by the upright rear wall 28, and thus the sand suspended in that returning water will be deposited behind the block to thereby build the beach. As such, there is novelty in the concept of preventing the free return flow of the water to the extent that it impinges against the upright solid wall 28, and thus a beach is actually being built by avoiding the erosion.

FIG. 2 also actually shows that the inclined surface 12 extends to intersect with the rear wall 28 at the horizontal line 29, and there is of course one inclined wave passageway 21 extending through the entire block body 10, and thus the return of the water flow can go through the passageway 21, but after it is blocked by the solid back wall 28 and to the extent that it extends to the line 29.

The drawings also show that the rear wall portion 28 extends beyond the side wall 14 in the extension designated 31. Also, the rear wall 28 has a corner notch designated 32 behind the side wall 16. With that arrangement, the blocks 10 can be placed in side-by-side position in line with each other with the projection 31 received within the notch 32, and thus the blocks are interlocked or mated together to enhance the stability of the blocks in their in-line or in-row position.

The block is thus formed by having the triangular-shaped body 10 formed with a narrowing singular flow passage 21 extending therethrough and with having a solid bottom surface 11 which presents a solid lower portion 33 for the block. Also, the passageway 21 cuts underneath the block cross-bar or top portion 17, and the rear wall 28 is of a solid wall without openings and therefore available for precluding return flow past the block 10, and thus the beach is developed or built behind the block 10 when the sand falls from the water which is retarded in its return flow. With the single passageway 21 formed in the block 10, the block then has interior side wall surfaces 34 and 36, and a wave directed angularly at either side wall 34 or 36 will impinge thereagainst and thus be dissipated and will undoubtedly partly flow through the rear opening 22, all so that the block 10 remains in place and the wave energy is dissipated.

The row of blocks as described in this invention is most efficiently used in conjunction with a groin which can be formed from a row of solid abutment members placed perpendicular to the shoreline and extending past the beach building blocks of this invention. As such, the groin will serve to further diminish the wave detrimental action, and the blocks will be able to serve their complete function of dissipating wave energy while building the sandy beach behind the blocks and yet permitting the necessary return of flow of the water in the seaward direction where the height of the return flow is greater than that of the wall 28. Thus there is the rear or landwardly facing upright surface defined by everything seen as rearwardly projected in FIG. 4; and the portion thereof below the elevation of line 29 is the solid upright wall portion 28.

What is claimed is:

1. A beach building block comprising a body having a planar bottom surface and a seaward-facing inclined front surface and a landward-facing upright back surface and with said inclined front surface and said upright back surface meeting together at a top portion and with said body having a triangular configuration in its side-view silhouette when viewed from the side-view directly along said surfaces, said body having only one inclined wave passageway extending therethrough from said inclined front surface adjacent said bottom surface to said upright back surface adjacent and beneath said top portion, said inclined front surface being disposed and arranged to receive a wave and direct it upwardly and partly into said inclined passageway and partly above said top portion to thereby divide said wave into two wave parts in the flow of the wave beyond said upright back surface and for subsequent intersection of the two wave parts into each other to thereby reduce the force of the wave flow and thereby induce fallout of sand at the location adjacent said upright back surface, and said upright back surface including a solid upright wall portion extending from said bottom surface and upwardly to said passageway, and being free of any opening therein, for obstructing the flow of water in the seaward direction to thereby trap the sand suspended in the water and thereby build a beach at the locale to the back of said block in the landward-facing direction.

2. A beach building block as claimed in claim 1, wherein said upright back surface is disposed along a plane which is at an obtuse angle with said bottom surface, to thereby have said upright back surface disposed to be inclined toward the landward-facing direction for confining the sand against flow in the seaward-facing direction.

3. A beach building block as claimed in claim 1, wherein said body includes a toe portion extending from said bottom surface and beyond the plane which extends along said inclined front surface and with said toe portion extending in the seaward-facing direction for protection against washout of sand adjacent said inclined front surface.

4. A beach building block as claimed in claim 1, wherein said solid upright wall portion extends upwardly for at least two-thirds the total height of said upright surface for limiting flow impinging against said upright surface in the seaward-facing direction.

5. A beach building block as claimed in claim 3, wherein said solid upright wall portion extends upwardly for at least two-thirds the total height of said upright surface for limiting flow impinging against said upright surface in the seaward-facing direction.

6. A beach building block as claimed in claim 1, wherein said passageway is of a tapered shape to be progressively narrower in cross-section along its length toward said upright back surface for dividing the wave into the parts flowing above and below said top portion.

7. A beach building block as claimed in claim 1, wherein the opposite sides of said body have parallel faces and mating interengageable portions which interlock with each other when a plurality of said blocks are placed in line in side-by-side positions for restraining out-of-line movement of any one of said blocks.

8. A beach building block as claimed in claim 7, and said body includes a toe portion extending from said bottom surface and beyond the plane which extends along said inclined front surface and with said toe portion extending in the seaward-facing direction for protection against washout of sand adjacent said inclined front surface.

9. A beach building block as claimed in claim 1, wherein said body includes two spaced-apart side walls extending at an elevation higher than said inclined surface and being on each side of said inclined surface and being available for receiving the flow of water directed at an angle toward said walls and thereby dissipate the force of the flow.

* * * * *